US006107592A

United States Patent [19]

Morita et al.

[11] Patent Number: 6,107,592

[45] Date of Patent: Aug. 22, 2000

[54] VACUUM SWITCHING APPARATUS

[75] Inventors: Ayumu Morita, Hitachi; Makoto Yano, Mito; Toru Tanimizu, Hitachi, all of Japan

[73] Assignee: Hitachi, Ltd., Tokyo, Japan

[21] Appl. No.: 09/268,679

[22] Filed: Mar. 16, 1999

[30] Foreign Application Priority Data

Jan. 25, 1999 [JP] Japan ..... 11-15217

[51] Int. Cl.[7] ..... H01H 33/66

[52] U.S. Cl. ..... 218/118; 218/135

[58] Field of Search ..... 218/43, 118, 120, 218/123, 124, 134, 135, 140, 154

[56] References Cited

U.S. PATENT DOCUMENTS

| | | | |
|---|---|---|---|
| 4,079,217 | 3/1978 | Oeschger | 218/118 |
| 4,585,913 | 4/1986 | Yorita | 218/118 |
| 4,996,397 | 2/1991 | Kuhn et al. | 218/22 |
| 5,719,365 | 2/1998 | Tanimizu et al. | 218/118 |
| 5,747,766 | 5/1998 | Waino et al. | 218/140 |

FOREIGN PATENT DOCUMENTS 9-153320 6/1997 Japan .

*Primary Examiner*—Lincoln Donovan
*Attorney, Agent, or Firm*—Beall Law Offices

[57] ABSTRACT

A vacuum switching apparatus for automatically performing a series of breaking and disconnecting operations includes a fixed electrode and a movable electrode mounted in a vacuum vessel. The movable electrode is sequentially movable between a closing position, an opening position and a disconnecting position. After the movable electrode passes through the opening position located between the closing position and the disconnecting position, the between-electrode opening speed of the movable electrode is reduced by a decelerating means. With this configuration, it is possible to move the movable electrode from the closing position to the disconnecting position without lowering the breaking performance, and hence to automatically perform a series of breaking and disconnecting operations.

11 Claims, 6 Drawing Sheets

VACUUM SWITCHING APPARATUS

BACKGROUND OF THE INVENTION

The present invention relates to a vacuum switching apparatus having a function of breaking a large current.

In general, a power receiving/transforming apparatus receives power by a breaker and a disconnector; transforms the power voltage into a voltage suitable for a load by a transformer; and supplies the power thus voltage-transformed to the load. Upon maintenance and inspection of a power receiving/transforming apparatus, in order to keep or ensure the safety of an operator, a breaker is turned off and then a disconnector is turned off for preventing power from being applied again from the power supply side, and further an earthing or grounding switch is turned on to allow remaining charges and an induction current on the power supply side to flow on the earthing side. As one example of a power receiving/transforming apparatus, a gas insulation switching apparatus disclosed in Japanese Patent Laid-open No. Hei 3-273804 is configured such that a breaker, a disconnector, an earthing switch, and a current transformer are individually prepared and are stored in a unit chamber filled with an insulating gas. As another example of a power receiving/transforming apparatus, a switching apparatus disclosed in Japanese Patent Laid-open No. Hei 9-153320 is configured such that it includes a means of stopping a movable conductor 19 at four positions, specifically, a closing position Y1, an opening position Y2, a disconnecting position Y3, and an earthing position Y4 or stopping the movable conductor 19 at three positions, specifically, at the closing position Y1, disconnecting position Y3, and earthing position Y4, to thus build-up three functions of the breaker, disconnector and earthing switch or two functions of the disconnector and earthing switch in a vacuum bulb.

The above-described former vacuum switching apparatus, in which the breaker and disconnector are individually arranged, has a problem in enlarging the size of the apparatus, and has another problem in making the usability poor and causing the possibility of misoperation of an operator because a series of breaking and disconnecting operations upon maintenance and inspection cannot be continuously performed.

The above-described latter vacuum switching apparatus, in which the breaker and disconnector are built-up in one vacuum vessel, has a problem in that in makes the operating mechanism complicated. In a vacuum breaker, there is specified a between-electrode opening distance most suitable for breaking a large current. If the between-electrode opening distance is excessively large, a region in which metal particles released from both electrodes are diffused increases, whereby insulators around the electrodes are contaminated, thereby reducing the insulating performance of a vacuum bulb. Moreover, since the arc length increases, it makes the behavior of the arc unstable, tending to reduce the breaking performance. Conversely, if the between-electrode opening distance is excessively small, the electrodes cannot withstand a transient recovery voltage applied between the electrodes after breaking, causing dielectric breakdown, thus, making breaking impracticable. In view of the foregoing, the prior art switching apparatus must be configured to complete the breaking operation in a state in which the movable conductor is stopped once at a suitable opening position, and then to perform the disconnecting operation separately from the breaking operation. This configuration causes an inconvenience in complicating the operating mechanism.

SUMMARY OF THE INVENTION

An object of the present invention is to provide a vacuum switching apparatus which is capable of improving the usability, reducing the possibility of misoperation by an operator, and simplifying and miniaturizing the operating mechanism as compared with that, of the prior art switching apparatus, which is operated in two stages.

To achieve the above object, according to the present invention, there is provided a vacuum switching apparatus which includes a fixed electrode provided in a vacuum vessel and a movable electrode, also provided in the vacuum vessel, which is moved between a closing position and an opening position and between the opening position and a disconnecting position, and which is stopped at the closing position and the disconnecting position. A means is provided for bringing the movable electrode into contact with the fixed electrode or separating the movable electrode from the fixed electrode and a decelerating means is provided making the speed of the movable electrode during movement from the opening position to the disconnecting position less than a moving speed of the movable electrode during movement from the closing position to the opening position.

According to the present invention, there is also provided a vacuum switching apparatus which includes a fixed electrode provided in a vacuum vessel; a movable electrode, also provided in the vacuum vessel, which is moved between a closing position and an opening position and between the opening position and a disconnecting position, and which is stopped at the closing position and the disconnecting position. A means is provided for bringing the movable electrode into contact with the fixed electrode or separating the movable electrode from the fixed electrode and a decelerating means is provided for making the speed of the movable electrode during movement from he opening position to the disconnecting position less than the moving speed of the movable electrode during movement from the closing position to the opening position and wherein a between-electrode opening distance $D_2$ between the fixed electrode and the movable electrode at the opening position and a between-electrode opening distance $D_3$ between the fixed electrode and the movable electrode at the disconnecting position satisfy a relationship of $0.5 \times D_3 \leqq D_2 \leqq 0.7 \times D_3$.

According to the present invention, the above decelerating means preferably includes a shock absorber which begins to be operated when the movable electrode reaches the opening position.

According to the present invention, the above decelerating means preferably includes a breaking spring of a spring operating mechanism for driving the movable electrode and a shock absorbing spring which begins to be operated when the movable electrode reaches the opening position.

According to the present invention, a spring constant of the shock absorbing spring is preferably larger than a spring constant of the breaking spring.

According to the present invention, the above decelerating means may include a bellows whose spring constant increases when the movable electrode reaches the opening position; and the movable electrode is preferably fixed to the vacuum vessel via the bellows.

According to the present invention, it is possible to improve the usability and reduce the possibility of misoperation by an operator, and to simplify and miniaturize the operating mechanism as compared with that of the prior art switching apparatus, operated in two stages.

DETAILED DESCRIPTION OF THE PREFERRED EMBODIMENTS

Hereinafter, embodiments of the present invention will be described with reference to FIGS. 1 to 12.

Figure 1:
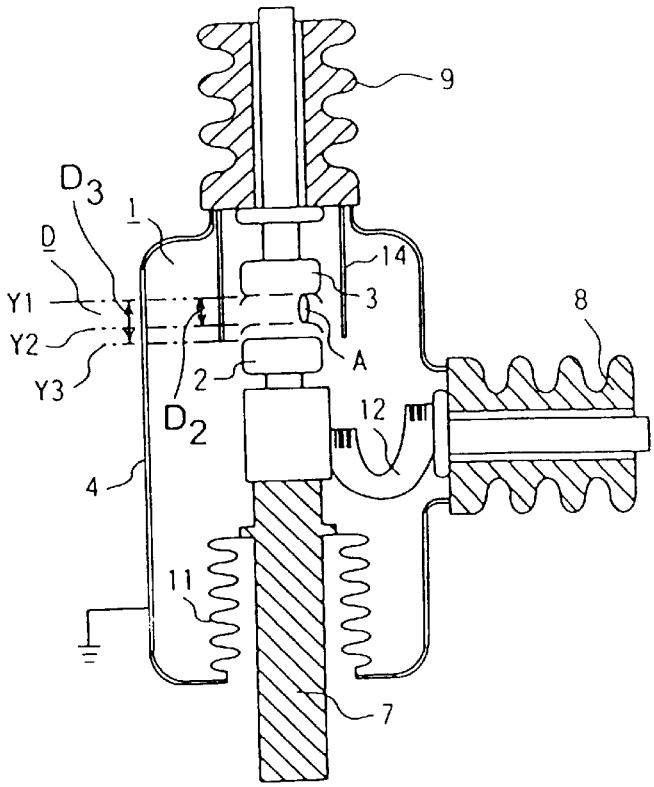
FIG. 1 is a vertical sectional view of a vacuum bulb according to a first embodiment of the present invention.

FIG. 1 shows a vacuum bulb or container 1 including a breaking function and a disconnecting function.

First, the structure of the vacuum bulb 1 will be described. A vacuum is created inside of a metal vessel 4. A movable electrode 2 and a fixed electrode 3 are arranged opposite to each other in the metal vessel 4 which is earthed or grounded. The fixed electrode 3 is connected to a bushing 9 and are, more specifically, is connected to a bus via the bushing 9. The movable electrode 2 is connected to a bushing 8 via a flexible conductor 12, and more specifically, is connected to a load via the bushing 8. In the vacuum bulb 1 in a closing state in which the movable electrode 2 is in contact with the fixed electrode 3, a current flows by way of a route of the fixed electrode 3, movable electrode 2, and flexible conductor 12. An arc shield 14 for preventing occurrence an earth or ground fault caused by direct-contact of an arc A with the metal vessel 4 upon breaking is provided around the fixed electrode 3. The arc shield 14 also plays a role in preventing scattering of metal particles released from the electrodes upon breaking, thereby preventing deterioration of an insulating performance, for example, contamination of an insulating rod 7 or the like due to the scattered metal particles. The movable electrode 2 is connected to the insulating rod 7. The movable electrode 2 is vertically driven via the insulating rod 7 by an operating mechanism (not shown) provided separately from the vacuum bulb 1, to be opened/closed with respect to the fixed electrode 3. The insulating rod 7 is connected to the metal vessel 4 via a bellows 11, and therefore, it is drivable by the insulating rod 7 in a state in which the vacuum of the inside of the metal vessel 4 is maintained.

Figure 2:
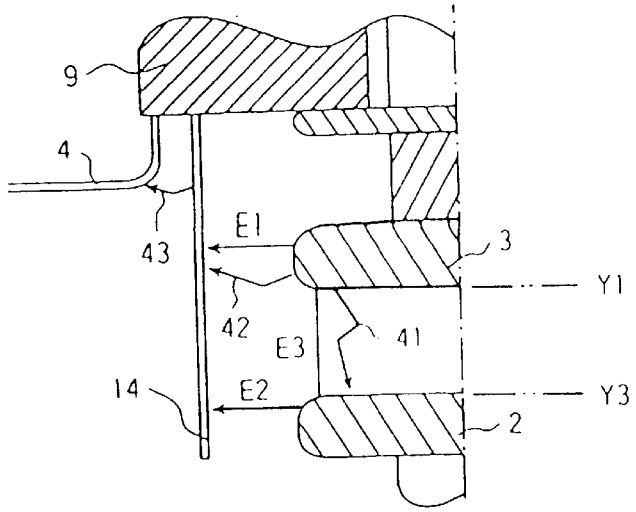
FIG. 2 is an enlarged view of an electrode and its adjacent area in the first embodiment of the present invention.

The movable electrode 2 is stopped at a closing position Y1 at which both the electrodes are in contact with each other and a disconnecting position Y3 at which insulation is kept maintained even if a surge voltage due to thunder or the like is applied. For example, as described in JEC standard 2300 and 2310, a between-electrode withstand voltage of a disconnector is set higher than that of a breaker. A between-electrode opening distance, an insulating distance between each electrode and an arc shield 14, and the like when the movable electrode 2 is stopped at the disconnecting position Y3 must be designed in accordance with the specification associated with the withstand voltage of the disconnector. Also to ensure the safety of an operator when the movable electrode 2 is stopped at the disconnecting position Y3, the coordination of insulation must be established such that even in the worst case, a dielectric breakdown does not occur between the electrodes by introducing the discharge on the earth or ground side. For example, as shown in FIG. 2, an electric field E3 between the electrodes is made smaller than each of an electric field E1 between the electrode 3 and the arc shield 14 and an electric field E2 between the electrode 2 and the arc shield 14, to cause the dielectric breakdown not in a discharge route 41 but in discharge routes 42 and 43. With this configuration, it is possible to ensure the safety of an operator.

Figure 3:
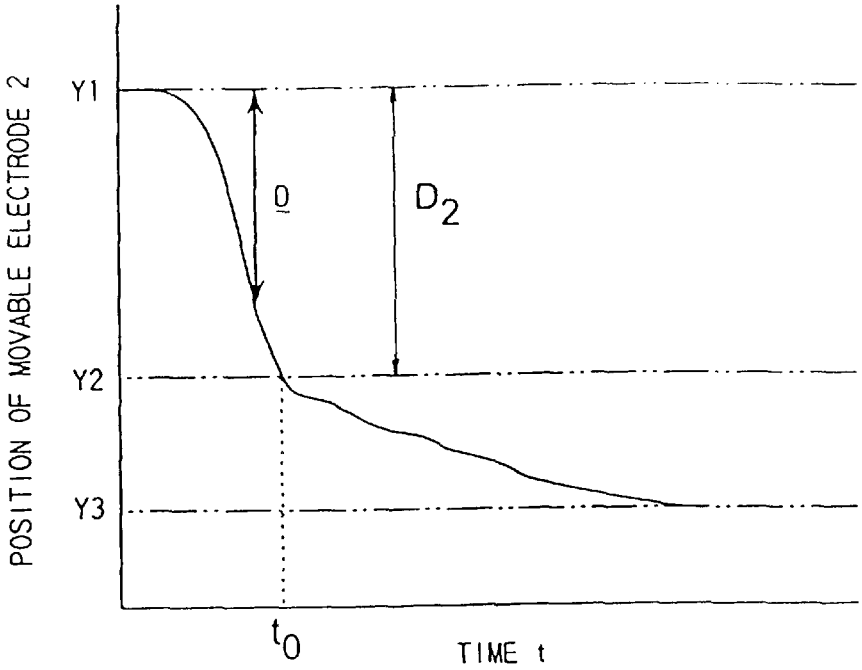
FIG. 3 is a graph illustrating a between-electrode opening characteristic of the first embodiment of the present invention.
Figure 4:
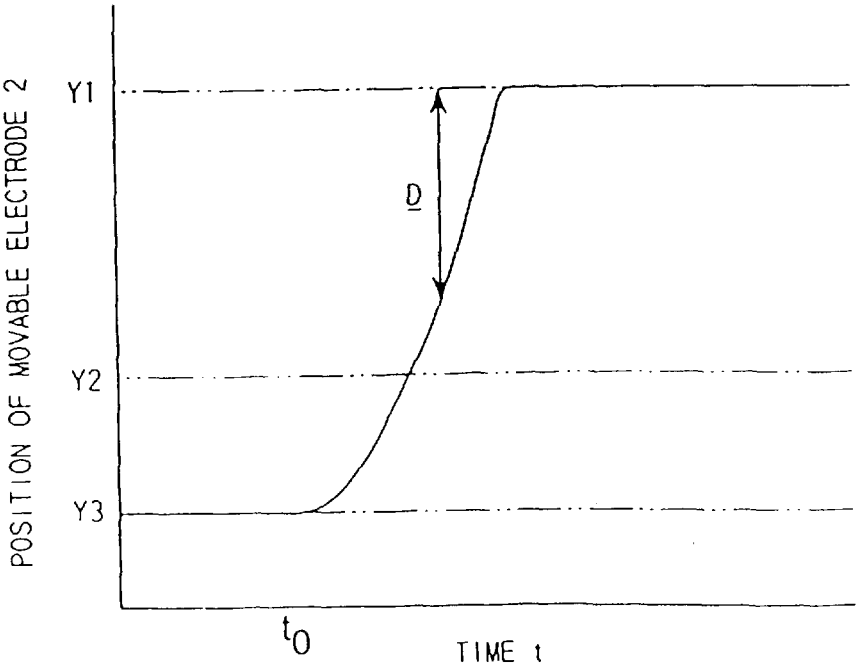
FIG. 4 is a graph illustrating a between-electrode closing characteristic of the first embodiment of the present invention.

Next, the switching characteristic of the vacuum switching apparatus in this embodiment will be described with reference to FIGS. 3 and 4. FIG. 3 shows a change in position of the movable electrode 2 with an elapsed time in the between-electrode opening operation. In the figure, symbol Y2 designates an opening position at which the current is broken in the vacuum switching apparatus, which position is located between the closing position Y1 and the disconnecting position Y3. The speed of the movable electrode 2 is forcibly decelerated after an elapse of a time $T_0$ at which the movable electrode 2 just passes through the opening position Y2, and is then moved to the disconnecting position Y3. FIG. 4 shows a change in position of the movable electrode 2 with an elapsed time in the between-electrode closing operation. The speed of the movable electrode 2 is accerlated from the disconnecting position Y3 to the closing position Y1.

The time to at which the deceleration of the speed of the movable electrode 2 begins upon the between-electrode opening operation is determined in accordance with the following procedure.

Figure 5:
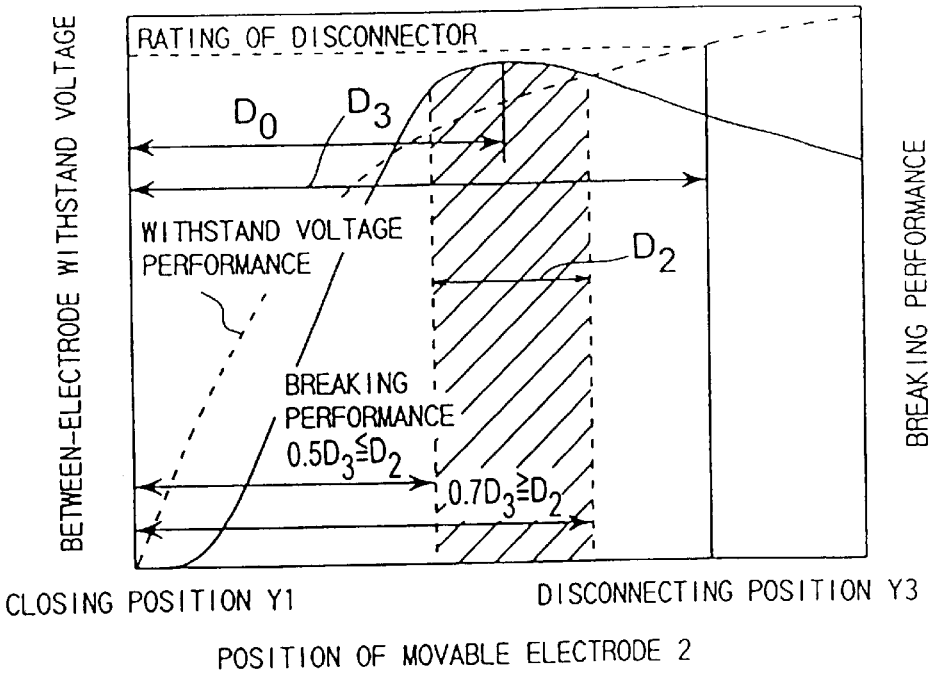
FIG. 5 is a characteristic diagram showing a relationship between each of a between-electrode withstand voltage and breaking performance and a position of a movable electrode according to the first embodiment.

FIG. 5 shows a relationship between each of the between-electrode withstand voltage and breaking performance and the position (between-electrode distance D) of the movable electrode 2. The between-electrode withstand voltage increases with the between-electrode distance D. Meanwhile, the breaking performance is maximized when the between-electrode distance reaches a value $D_o$ shown in FIG. 5, and it is reduced as the between-electrode distance D becomes larger than the value $D_0$. This is because when the between-electrode distance D is more than the value $D_0$, a region in which insulators are contaminated by metal particles released from the electrodes is increased, with a result that the breaking performance is reduced.

Here, a between-electrode distance $D_3$ is that in a state in which the movable electrode 2 is stopped at the disconnecting position Y3.

As is apparent from FIG. 5, it is desirable that the breaking operation be performed in a state in which the breaking performance is high and also the between-electrode withstand voltage is high, that is, in a hatching region in the figure (the between-electrode distance D lies in a range of $0.5\times D_3 \leqq D_2 \leqq 0.7\times D_3$). Accordingly, the between-electrode distance $D_2$ in a state in which the movable electrode 2 is located at the opening position Y2 is desirable to be in a range of $0.5\times D_3 \leqq D_2 \leqq 0.7\times D_3$ based on the between-electrode distance $D_3$ in a state in which the movable electrode 2 is stopped at the disconnecting position Y3.

Figure 6:
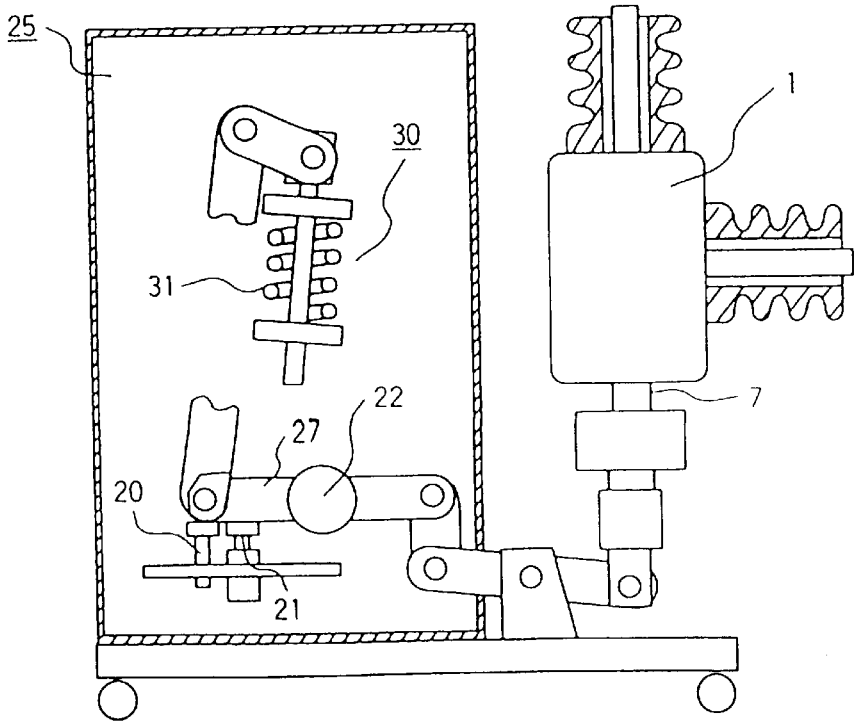
FIG. 6 is a schematic view of an operating mechanism according to a second embodiment of the present invention.

An operating mechanism for giving a concrete form to the above switching characteristic will be described with reference to FIG. 6. FIG. 6 shows a switching apparatus for operating the vacuum bulb 1 shown in FIG. 1 by a spring operating mechanism 25. In the figure, reference numeral 30 designates a breaking spring portion in which a biased breaking spring 31 is released by a trip mechanism provided separately from the breaking spring portion 30 to generate a drive force. The drive force is transmitted to the insulating rod 7 via a shaft 22 or the like. Reference numeral 20 designates a stopper. The stopper 20 restricts the rotational amount of the shaft 22 to determine the moving distance of the movable electrode 2. The stopper 20 is adjusted such that the shaft 22 is brought in contact with the stopper 20 when the movable electrode 2 reaches the disconnecting position Y3. A shock absorber 21 is provided on a link portion 27. The shock absorber 21 is adjusted such that it begins to be operated when the movable electrode 2 reaches the opening position Y2.

According to the present invention, the operational state automatically comes into the breaking state with the between-electrode distance D kept at the value $D_0$ suitable for breaking. That is to say, a series of the breaking and disconnecting operations can be automatically performed without reducing the breaking performance. This switching apparatus makes it possible to improve the usability and to eliminate the possibility of misoperation by an operator. Also the operating mechanism is simplified as compared with that in the prior art switching apparatus in which the breaking and disconnection have been operated in two steps. Further, since the between-electrode opening speed of the movable electrode 2 is reduced before the movable electrode 2 reaches the stopping position, that is, the disconnecting position Y3, an impact force is reduced, thereby improving the mechanical lives of the vacuum bulb 1, bellows 11, operating mechanism 25 and the like. In this embodiment, the following effect in terms of the throwing performance can be also obtained. Since the throwing begins from the disconnecting position Y3, the throwing stroke becomes longer than that in the prior art switching apparatus, to increase the throwing speed just before the contact between the electrodes. In a vacuum breaker, an arc is generated between the electrodes in a state in which the electrodes come closer to each other with a micro-gap put therebetween just before throwing, giving rise to a problem associated with fusion between the electrodes after throwing. For this reason, the prior art operating mechanism has required a trip force more than the fusion force acting between the electrodes. On the contrary, according to the present invention, since the throwing speed is increased, the generating time of an arc, that is, the fusion force produced between the electrodes is reduced. This is effective to make lower the necessary operating force.

Figure 7:
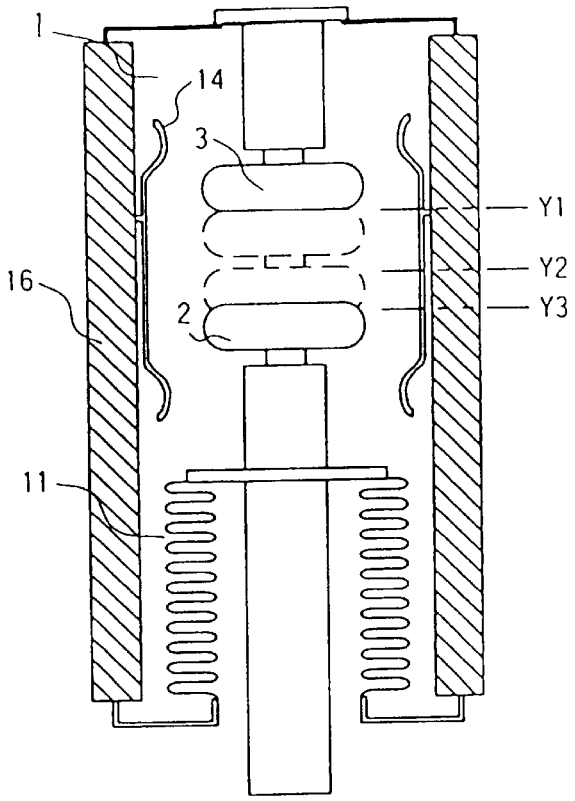
FIG. 7 is a vertical sectional view of a vacuum bulb according to a third embodiment of the present invention.

In the first and second embodiments, description is made by example of the vacuum bulb in which the metal vessel is earthed; however, as described in this embodiment, the present invention can be applied to a vacuum bulb in which the metal vessel is not earthed. FIG. 7 shows a vacuum bulb in which a movable electrode 2 is driven in the axial direction, and a ceramic cylinder 16 is provided on the outer peripheral sides of a fixed electrode 3 and the movable electrode 2. An arc shield 14 is provided between the outer peripheries of the fixed electrode 3 and the movable electrode 2 and the ceramic cylinder 16 in order to prevent the insulating performance of the ceramic cylinder 16 from being deteriorated due to adhesion of ions and electrons scattered upon generation of an arc on the ceramic cylinder 16. A bellows 11 is provided around a conductor portion of the movable electrode 2, and the inside of the vacuum bulb surrounded by the bellows 11, whereby the ceramic cylinder 16 and the like is kept in a vacuum. The above conductor portion is connected to the operating mechanism 25 shown in FIG. 6 via an insulator.

The movable electrode 2 is stopped at a closing position Y1 and a disconnecting position Y3, and the moving speed of the movable electrode 2 is reduced after the movable electrode 2 passes through the opening position Y2. The adjustment of the moving speed of the movable electrode 2 is performed by the shock absorber 21 of the operating mechanism 25 shown in FIG. 6. The between-electrode withstand voltage when the movable electrode 2 is stopped at the disconnecting position Y3 is set higher than the withstand voltage between the outer portion of the vacuum bulb and the earth to realize the coordination of insulation.

A control system such as a servo or feedback system may be provided by mounting a position sensor on an air operating mechanism other than the spring operating mechanism, such as the shock absorber or link portion. In this case, the same effect as that described above can be obtained.

In this embodiment, the present invention is applied to a vacuum bulb in which a metal vessel is not earthed and an operating blade including a movable electrode 2 is turned around a main shaft 20.

Figure 8:
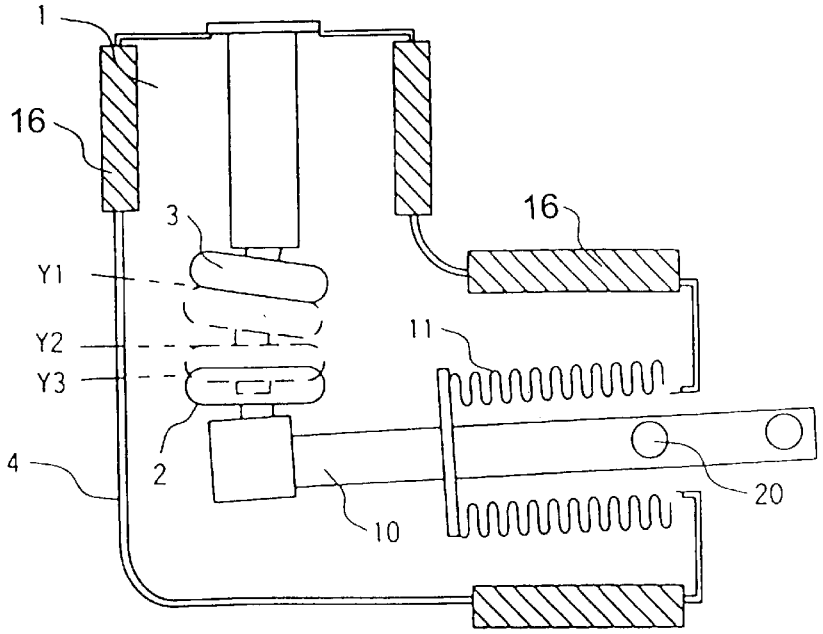
FIG. 8 is a sectional side view of a vacuum bulb according to a fourth embodiment of the present invention.

FIG. 8 shows a vacuum bulb in which an operating blade including a movable electrode 2 is turned around a main shaft 20 and a ceramic cylinder 16 is provided on the outer peripheral sides of a fixed electrode 3 and the movable electrode 2. An arc shield (not shown) is provided between the outer peripheries of the fixed electrode 3 and the movable electrode 2 and the ceramic cylinder 16 in order to prevent the insulating performance of the ceramic cylinder 16 from being deteriorated due to adhesion of ions and electrons scattered upon generation of arc on the ceramic cylinder 16. A bellows 11 is provided around a conductor portion of the movable electrode 2, and the inside of the vacuum bulb surrounded by the bellows 11, the ceramic cylinder 16 and the like is kept in a vacuum. The above conductor portion is connected to the operating mechanism 25 shown in FIG. 6 via an insulator.

The movable electrode 2 is stopped at a closing position Y1 and a disconnecting position Y3, and the moving speed of the movable electrode 2 is reduced after the movable electrode 2 passes through an opening position Y2. The adjustment of the moving speed of the movable electrode 2 is performed by the shock absorber 21 of the operating mechanism 25 shown in FIG. 6. The between-electrode withstand voltage when the movable electrode 2 is stopped at the disconnecting position Y3 is set higher than the withstand voltage between the outer portion of the vacuum bulb and the earth to realize the coordination of insulation.

A control system such as a servo or feedback system may be provided by mounting a position sensor on an air operating mechanism other than the spring operating mechanism, such as the shock absorber or link portion. In this case, the same effect as that described above can be obtained.

Figure 9:
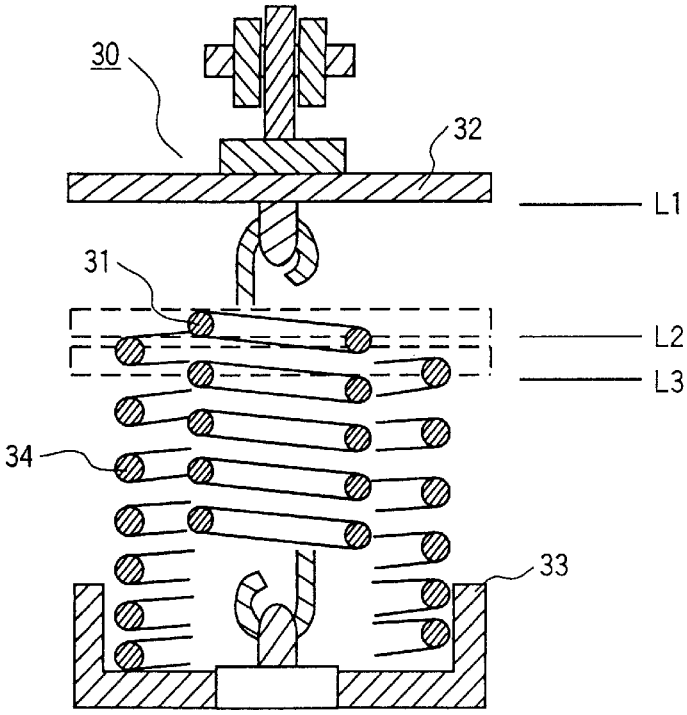
FIG. 9 is a sectional view of a breaking spring portion of an operating mechanism according to a fifth embodiment of the present invention, in which the breaking spring portion having a function of a shock absorber includes a tensile type breaking spring.

In this embodiment, the breaking spring portion 30 of the spring operating mechanism 25 shown in FIG. 6 is modified to have the function of the shock absorber 21. FIG. 9 shows the modified structure of the breaking spring portion 30, which includes a tensile type breaking spring 31 and spring supporting fixtures 32 and 33 for fixing both the ends of the breaking spring 31. The supporting fixture 32 is stopped at a position L1 when the movable electrode 2 is located at the closing position Y1; is stopped at a position L3 when the movable electrode 2 is located at the disconnecting position Y3; and passes through a position L2 when the movable electrode 2 reaches the opening position Y2. Here, a shock absorbing spring 34 is separately provided outside or inside the breaking spring 31, which spring 34 begins to be operated when the supporting fixture 32 passes through the position L2. Thus, the shock absorbing spring 34 is adjusted to begin to be operated when the movable electrode 2 reaches the opening position Y2.

Figure 10:
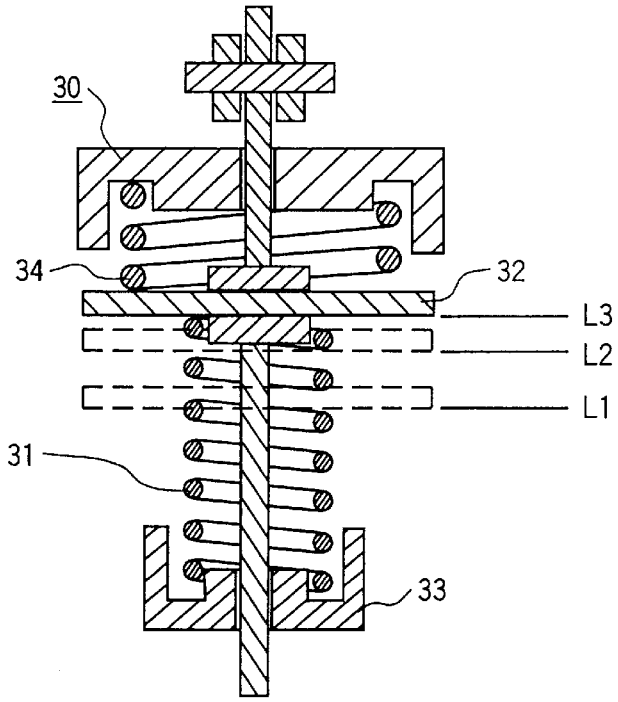
FIG. 10 is a sectional view of a breaking spring portion of an operating mechanism according to a sixth embodiment of the present invention, in which the tensile type breaking spring shown in FIG. 9 is replaced with a compression type breaking spring.

FIG. 10 shows an embodiment in which the tensile coil of the breaking spring 31 in the fifth embodiment is replaced with a compressive coil. Even in this embodiment, the shock absorbing spring 34 is adjusted such that it begins to be operated when the supporting fixture 32 passes through the position L2. Accordingly, when the movable electrode 2 reaches the opening position Y2, the shock absorbing spring 34 acts as a brake to reduce the between-electrode opening speed of the movable electrode 2. The shock absorbing spring 34 in this embodiment exhibits the same effect as that obtained by using the shock absorber 21 in the first embodiment. It should be noted that the decelerating effect can be increased by making a spring constant of the shock absorbing spring 34 larger than a spring constant of the breaking spring 31.

Figure 11:
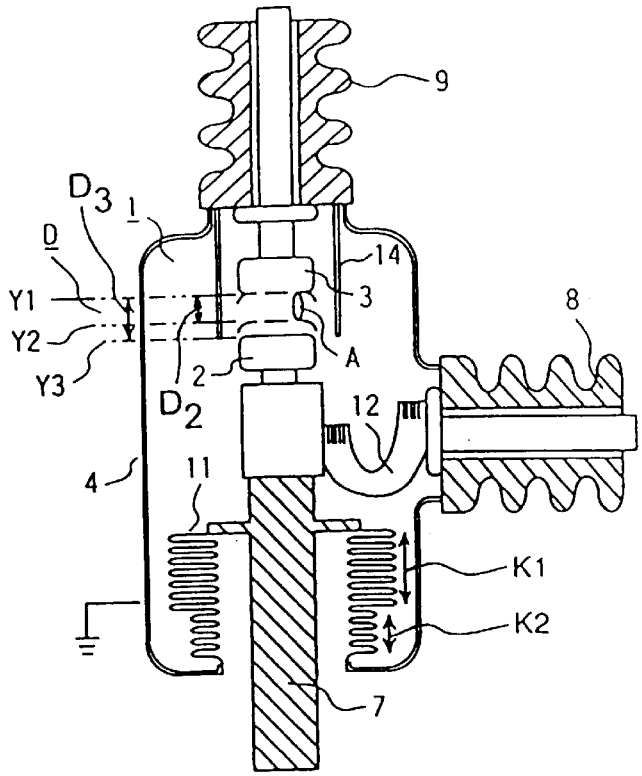
FIG. 11 is a vertical sectional view of a vacuum bulb according to a seventh embodiment of the present invention.

FIG. 11 shows an embodiment in which the bellows 11 described in the previous embodiments is modified to have the function of reducing the between-electrode opening speed. The bellows 11 in this embodiment has a portion K1 having a large spring constant and a portion K2 having a small spring constant. With this configuration, when the movable electrode 2 is moved at a high speed, the portion K2 having the small spring constant is mainly actuated, and when the movable electrode 2 reaches the opening position Y2, the portion K2 is sufficiently compressed and the portion K1 having the large spring constant begins to be actuated. Thus, after the movable electrode 2 passes through the opening position Y2, the portion K1 having the large spring constant is actuated, to thereby reduce the between-electrode opening speed of the movable electrode 2. This embodiment is advantageous in that the operating mechanism adopted in the prior art breaker can be used as it is.

Figure 12:
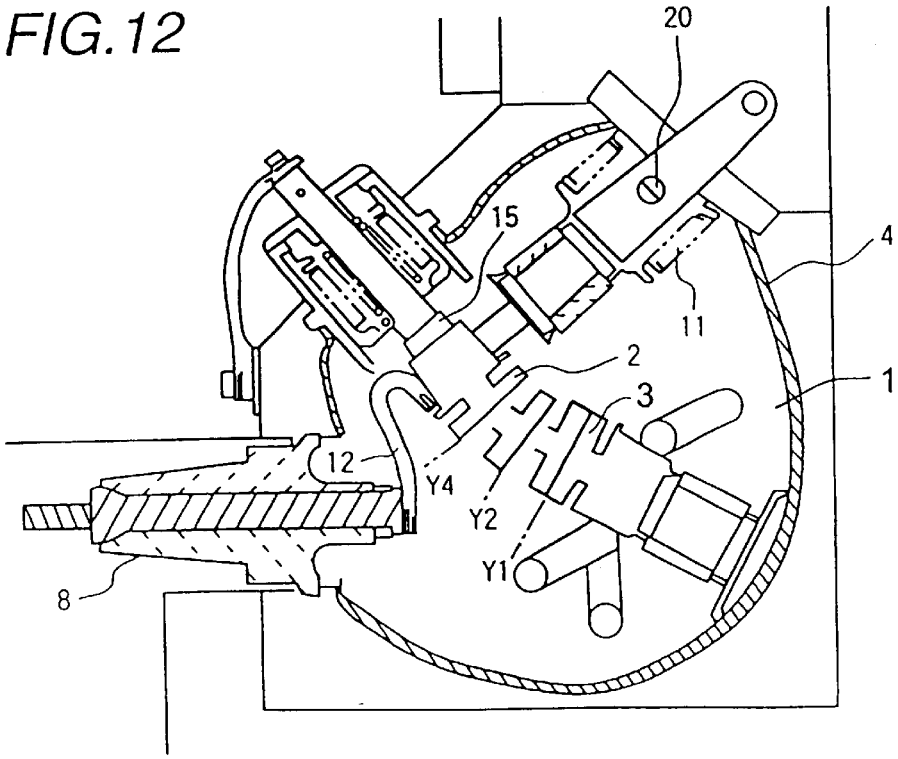
FIG. 12 is a vertical sectional view of a vacuum bulb according to an eighth embodiment of the present invention.

FIG. 12 shows a vacuum bulb in which a breaker and an earthing switch are built-up. A fixed electrode 3, a movable electrode 2, an earthing switch 15 are arranged in an earthed metal vessel 4 in such a manner as to be insulated from the metal vessel 4. The movable electrode 2 is stopped at a closing position Y1 and an earthing position Y4. During movement of the movable electrode 2 from the closing position Y1 to the earthing position Y4, the between-electrode opening speed of the movable electrode 2 is reduced after the movable electrode 2 passes through an opening position Y2. Either the shock absorber 21 shown in FIG. 6 or the shock absorbing spring 34 shown in FIGS. 9 and 10 is used as a decelerating means in this embodiment. With this configuration, the breaking and earthing operations can be automatically, continuously performed only by a single operating mechanism. It should be noted that the vacuum bulb 1 shown in FIG. 12 may be configured such that the movable electrode 2 is stopped at the closing position Y1 and a disconnecting position (not shown) between the opening position Y2 and the earthing position Y4 for realizing the breaking and disconnecting functions, and the movable electrode 2 and earthing switch 15 are opened/closed by a separate operating mechanism to realize the earthing function. This is advantageous in that the breaking, disconnecting and earthing functions can be built-up in the single vacuum bulb, thereby making the entire structure of the switching apparatus small.

While the preferred embodiments of the present invention have been described using the specific terms, such description is for illustrative purposes only, and it is to be understood that changes and variations may be made without departing from the spirit or scope of the following claims.

What is claimed is:

1. A vacuum switching apparatus comprising:

a fixed electrode and a movable electrode mounted in a vacuum vessel; said movable electrode being mounted in said vacuum vessel by means of a bellows surrounding an indulating rod connected to said movable electrode;

said movable electrode being movable between a closing position Y1 and an opening position Y2 where a current between said stationary electrode and said movable electrode is broken and between said opening position Y2 and a disconnecting position Y3 and wherein said movable electrode is stationary only when at said closing position Y1 and when at said disconnecting position Y3;

a means for bringing said movable electrode into contact with said fixed electrode or separating said movable electrode from said fixed electrode; and a decelerating means for controlling a speed of said movable electrode during movement from said opening position Y2 to said disconnecting position Y3 to be less than a speed of said movable electrode during movement from said closing position Y1 to said opening position Y2 and wherein a between-electrode opening distance $D_2$ between said opening position Y2 and said closing position Y1 is not smaller the $0.5 \times D_3$ and not larger than $0.7 \times D_3$ wherein $D_3$ is a between-electrode distance at said disconnecting position Y3.

2. A vacuum switching apparatus comprising:

a fixed electrode and a movable electrode mounted in a vacuum vessel; said movable electrode being mounted in said vacuum vessel by means of a bellows surrounding and insulating rod connected to said movable electrode;

said movable electrode being movable between a closing position Y1 and an opening position Y2 wherein a current between said stationary electrode and said movable electrode is broken and between said opening position Y2 and a disconnecting position Y3, and wherein said movable electrode is stationary only when at said closing position Y1 and when at said disconnecting position Y3;

a means for bringing said movable electrode into contact with said fixed electrode or separating said movable electrode from said fixed electrode; and a deceleration means for controlling a speed of said movable electrode during movement from said opening position Y2 to said disconnecting position Y3 to be less than a speed of said movable electrode during movement from said closing position Y1 to said opening position Y2; and wherein a between-electrode opening distance $D_2$ between said fixed electrode and said movable electrode at said opening position Y2 and a between-electrode opening distance $D_3$ between said fixed electrode and said movable electrode at said disconnecting position Y3 satisfy a relationship of $$0.5\times D_3 \leqq D_2 \leqq 0.7\times D_3.$$

3. A vacuum switching apparatus according to claim 1, wherein said decelerating means comprises a shock absorber which begins to be operated when said movable electrode reaches said opening position.

4. A vacuum switching apparatus according to claim 1, wherein said decelerting means comprises a breaking spring of a spring operating mechanism for driving said movable electrode and a shock absorbing spring which begins to be operated when said movable electrode reaches said opening position.

5. A vacuum switching apparatus according to claim 4, wherein a spring constant of said shock absorbing spring is larger than a spring constant of said breaking spring.

6. A vacuum switching apparatus comprising:

a fixed electrode provided in a vacuum vessel;

A movable electrode mounted in said vacuum vessel by means of a bellows surrounding a movable electrode connected to an operatng mechanism, wherein said movable electrode is moved between a closing position Y1 and a disconnecting position Y3, and stops only at said closing position Y1 and said disconnecting position Y3;

the operating mechanism bringing said movable electrode into contact with said fixed electrode or separating said movable electrode from said fixed electrode; and a decelerating means which starts deceleration of a moving electrode at an opening position Y2 where a current between said stationary electrode and said moving electrode is broken and continues deceleration until said disconnecting position Y3, and wherein a between-electrode opening distance D3 between said opening Y2 and said closing position Y1 is not smaller than 0.5×D3, wherein D3 is a between-electrode distance at said disconnecting position Y3.

7. A vacuum switching apparatus according to claim 1, wherein one end of said bellows is fixed to said insulating rod and another end of said bellows is fixed to said vacuum vessel, and an arc shield surrounds at least said fixed electrode.

8. A vacuum switching apparatus according to claim 2, wherein one end of said bellows is fixed to said insulating rod and another end of said bellows is fixed to said vacuum vessel, and an arc shield surrounds at least said fixed electrode.

9. A vacuum switching apparatus according to claim 2, wherein said movable electrode is connected to a bushing via a flexible conductor and said fixed electrode is connected to a bus via a bushing.

10. A vacuum switching apparatus according to claim 2, wherein said movable electrode is connected to a bushing via a flexible conductor and said fixed electrode is connected to a bus via a bushing.

11. A vacuum switching apparatus according to claim 7, wherein one end of said bellows is fixed to said movable electrode and another end of said bellows is fixed to said vacuum vessel, and an arc shield surrounds at least said fixed electrode.

* * * * *